US005980031A

United States Patent [19]

Sasaki et al.

[11] Patent Number: 5,980,031

[45] Date of Patent: Nov. 9, 1999

[54] INK FILLING METHOD AND APPARATUS

[75] Inventors: Toshiaki Sasaki, Abiko; Hisashi Yamamoto, Machida, both of Japan

[73] Assignee: Canon Kabushiki Kaisha, Tokyo, Japan

[21] Appl. No.: 08/939,954

[22] Filed: Sep. 29, 1997

Related U.S. Application Data

[63] Continuation of application No. 08/371,856, Jan. 12, 1995, abandoned.

[30] Foreign Application Priority Data

Jan. 14, 1994 [JP] Japan ..... 6-002634

[51] Int. Cl.[6] ..... B41J 2/175

[52] U.S. Cl. ..... 347/85

[58] Field of Search ..... 347/85–87, 30, 347/35; 141/18, 20.5

[56] References Cited

U.S. PATENT DOCUMENTS

| | | | |
|---|---|---|---|
| 5,182,581 | 1/1993 | Kashimura et al. | 347/87 R |
| 5,199,470 | 4/1993 | Goldman | 347/87 R |
| 5,319,841 | 6/1994 | Yata et al. | 29/451 |
| 5,367,328 | 11/1994 | Ericson | 347/85 |
| 5,448,275 | 9/1995 | Fong | 347/87 |

FOREIGN PATENT DOCUMENTS

| | | |
|---|---|---|
| 0466142 | 1/1992 | European Pat. Off. . |
| 0 536 980 A2 | 4/1993 | European Pat. Off. . |
| 0567308 | 10/1993 | European Pat. Off. . |
| 0577439 | 1/1994 | European Pat. Off. . |

*Primary Examiner*—N. Le
*Assistant Examiner*—Judy Nguyen
*Attorney, Agent, or Firm*—Fitzpatrick, Cella, Harper & Scinto

[57] ABSTRACT

An ink filling method in which ink is filled to an ink container provided with a porous material for retaining the ink to be supplied to a head portion for ejecting the ink and a container casing for accommodating the porous material, including the steps of compressing the porous material accommodated in the container casing, and filling the ink using restoring force of the porous material when it is released from compression state

16 Claims, 5 Drawing Sheets

INK FILLING METHOD AND APPARATUS

This application is a continuation of application Ser. No. 08/371,856 filed Jan. 12, 1995, now abandoned.

FIELD OF THE INVENTION AND RELATED ART

The present invention relates to an ink filling method for a container for retaining ink usable for an ink jet recording device for executing the recording by ejecting the ink, and a device usable therefor, and an ink filling method capable of accomplishing a stable ink filling state, and a device usable therefor.

As types of recording elements in the ink jet recording, there are a cartridge type wherein a head portion and an ink container portion retaining the ink to be supplied to the head portion are unified and which is detachably mountable relative to the recording device, and the cartridge type wherein the head portion and the ink container portion are used in the unified state but the individuals are independently exchangeable, or the like.

In the ink container of such a structure, generally, in the inside thereof, a porous material is inserted in the state in which it is compressed to a certain degree, and the ink is contained and retained in the porous material. The ink retaining force of the porous material, results in a moderate negative pressure relative to the meniscus retaining force in the ink ejection outlet at the head portion, and the balance is provided, and therefore, the proper ink supply state is accomplished in response to the ink ejection without the ink leakage from the ink ejection outlet.

As to the porous material properly retaining the ink in such a manner, there is ether foamed polyurethane, for example. The ether foamed polyurethane uses polyether-polyol as polyol, and is polymerized with di-isocyanate; the foamed polyurethane being manufactured through a known method. it is cut into the predetermined size, and the film at the bubble portion is removed to provide open cells through a known method, and thereafter, it is heat-pressed at a high temperature, for example approx. 200 degrees C. into a predetermined compression state, and in addition, it is cut matching the inside volume of the ink container portion in which it is accommodated, so that a desired porous material is provided.

Thus provided porous material, is cleaned so as to prevent deterioration of the print quality by solution of the impurity into the ink it is compressed and is inserted into the ink container portion after drying. By this, the ink container wherein the porous material is accommodated in the compression state of a predetermined degree, is provided. As to the porous material provided without executing the heat-press process, the predetermined ink retaining force can be provided by inserting it into the ink container in the state in which it is mechanically compressed through predetermined degree.

As for the method for filling the ink into the ink container accommodating such a porous material, the pressure of the ink container inside is reduced to a substantial vacuum state, and the ink is filled using removal of the reduced pressure.

FIG. 1 is a flow chart showing an example of a conventional ink filling process. As shown in the FIG. 1, at step 1 (S1) is provided the ink container casing. At step 2, the machining of a connection portion with the head portion of the ink container is executed (S2). At step 3, the porous material is accommodated in the ink container (S3). At step 4, the accommodation opening of the porous material of the ink container is covered (S4). At step 5, checking is effected as to the leakage of ink container thus manufactured (S5). At step 6, the pressure of the ink container is reduced (S6). At step 7, the ink is filled (S7). At step 8, the excessive ink inside the container is removed. At step 9, the ink filling opening is sealed (S9). At step 10, the label having the lot number or the like is stuck (S10). At step 11, the ink container is packaged (S11). The ink container has conventionally been manufactured through these processes.

In the method of filling the ink using the reduced pressure state in this manner, the process is cumbersome, and in addition, the reduced pressure device is a bulky, with the result of the increase of the cost of the ink container.

In addition, in the ink container accommodating the porous material, depending on the state of the accommodation of the porous material, the portion in which close contacts occurs between the porous material and the ink container inside wall and the portion having a gap therebetween, exist in some cases.

In the case that there are the gap between the porous material and the ink container inside wall in this manner, the ink is filled also into the gap portion using the method filling the ink using the reduced pressure.

Such an ink, which will hereinafter be called "free ink", is not retained in the porous material, and therefore, the ink leakage from the ink container may occur. Therefore, after the ink is filled, the process of extracting the free ink as mentioned at above-described step 8 is required to remove the free ink, but the free ink is not always present at a predetermined position in the ink container and is different in the position for individual ink containers. Additionally, it does not always exist adjacent the ink supply opening for the ink filling but may be presents at the position most away from the ink supply opening as the case may be. Therefore, it is difficult to remove to the preferable extent only the free ink. Therefore, also the ink filled in the porous material may be removed by the free ink extraction operation, the variations of the distribution of the ink in the porous material and of the filling quantity of the ink, may result, in some cases.

Particularly, in such a case that the extraction operation for the free ink is carried out at the connection with the head portion of the ink container, the ink having been filled in the porous material adjacent the connection portion with the head portion, may be extracted together with the extraction of the free ink. When the state in which there is not the ink in the porous material adjacent the connection portion results in this situation, even if an attempt is made to execute the recording after connecting the head portion with the ink container portion, the flow of the ink toward the head from the ink container is stopped so that the supply of the ink is not carry out despite the ink full state.

SUMMARY OF THE INVENTION

It is a principal object of the present invention to provide a preferable ink filling method not requiring the extraction process for the free ink, that is, without the free ink and the apparatus usable therefor.

It is another object of the present invention to provide an ink filling method wherein the ink properly exists at the connection portion between the ink container and the head, and a device usable therefor.

It is a further object of the present invention to provide a filling method with which the variation of the distribution and/or the filling quantity of the ink does not easily occur and an apparatus usable for it.

It is a further object of the present invention to provide an ink container accomplishing the proper ink filling state.

As a result of considerable investigations to accomplish the above-described-object, the inventors of this application have found that without reducing the ink container pressure, the ink can be filled properly only to the porous material in the ink container by use of the deformation and the restoring force of the porous material.

The present invention is based on the above-described finding, and in an aspect thereof, in the ink filling method for filling the ink into the ink container provided with the porous material for retaining the ink to be supplied into the head portion for ejecting the ink to execute the recording, the porous material in the container is compressed, and the ink is then filled using the restoring force of porous material when is released the compression state.

In another aspect thereof, there is provided a device usable for the ink filling, comprising the member capable of executing the operation of compressing the porous material in the ink container and the operation of releasing the compressed state to remove the compression state, and the member supplying the ink in the ink container.

In an additional aspect, the ink filling is executed under the ambient pressure.

After the compression displacement of the porous material per se, the use is made to the negative pressure generated when the porous material is going to restore to the original configuration at the time of releasing the compression state, and the air in the bubbles in the porous material and the ink can be replaced with each other properly.

The replacement thereof can be executed uniformly in the entirety of porous material, and therefore, the distribution property of the ink and/or the injection accuracy is proper, and accumulation efficiency is proper in the ink filling method.

Therefore, the free ink is not produced, and the extraction process for the free ink becomes unnecessary.

These and other objects, features and advantages of the present invention will become more apparent upon a consideration of the following description of the preferred embodiments of the present invention taken in conjunction with the accompanying drawings.

Figure 1:
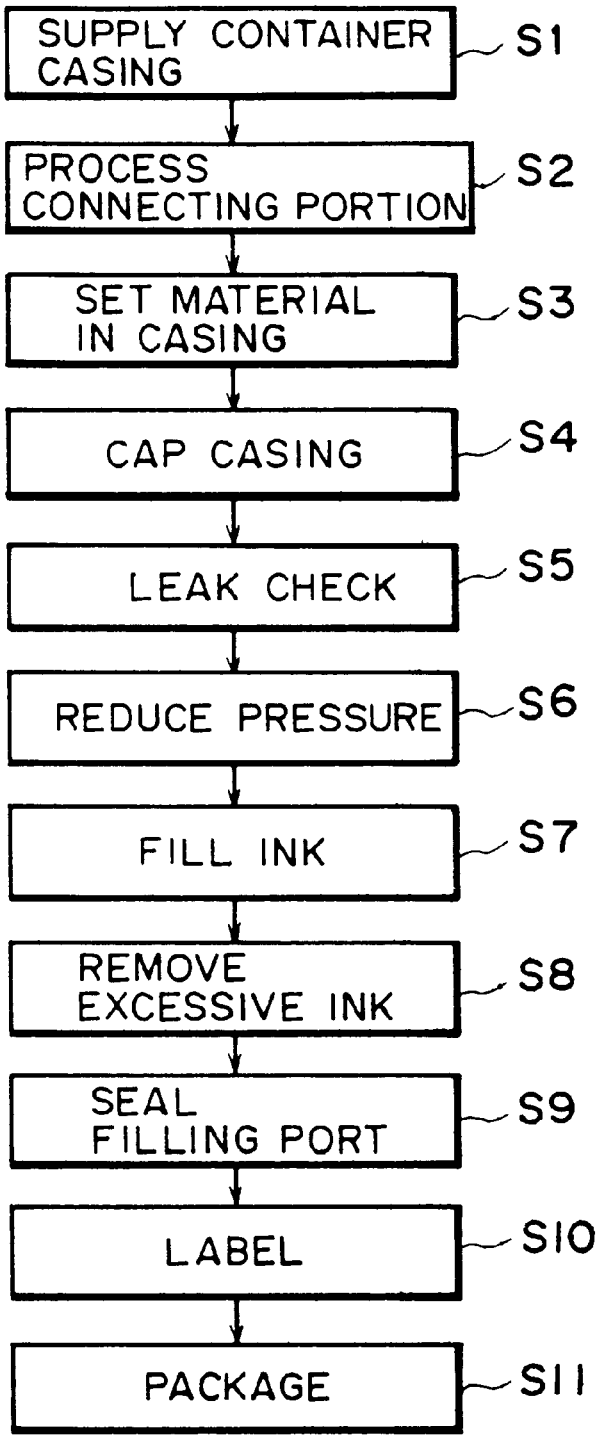
FIG. 1 PRIOR ART
FIG. 1 is a flow chart showing a conventional ink filling process.
Figure 2:
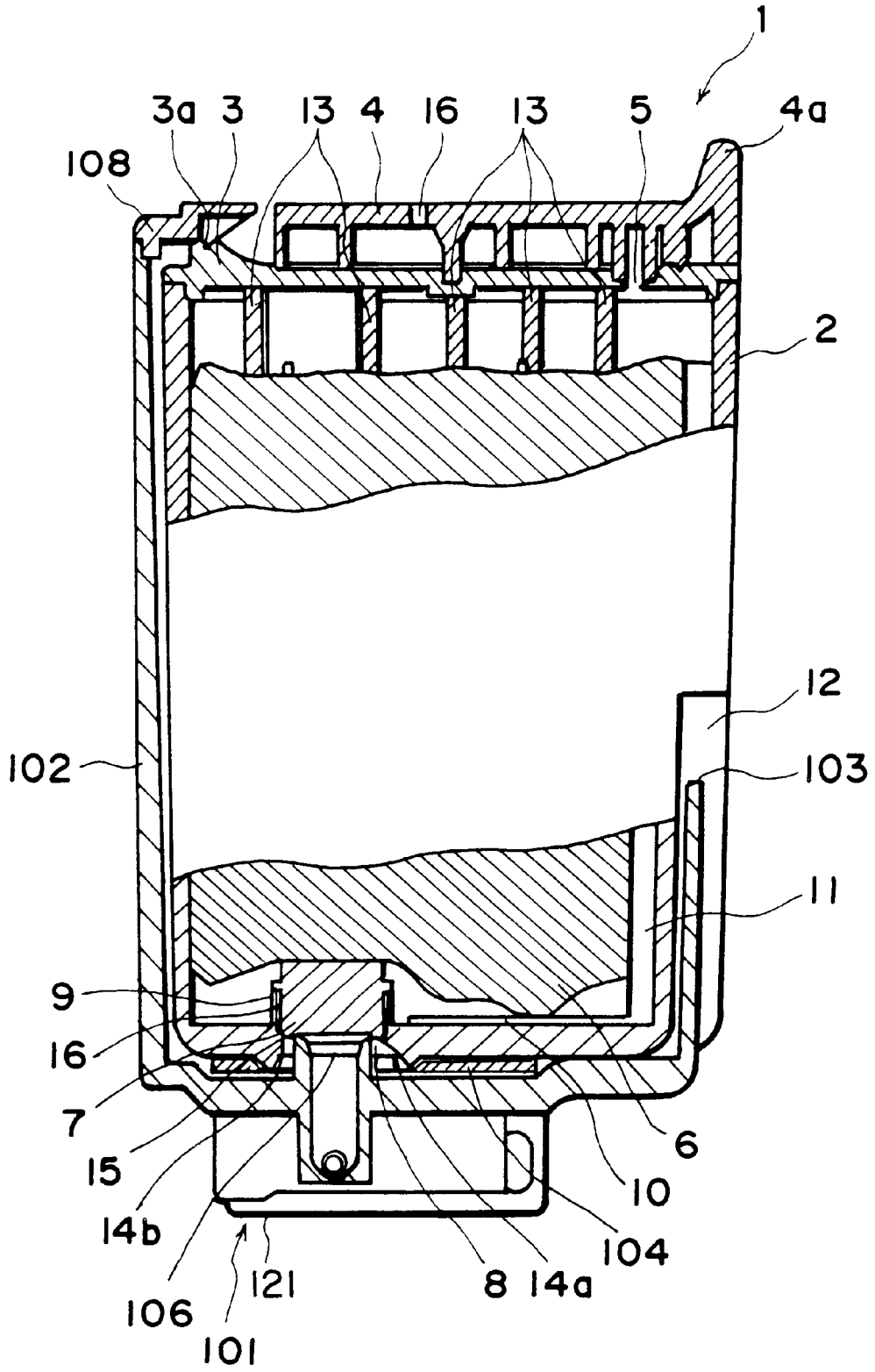

The FIG. 2 is a partly broken sectional view showing a part of structure of a portion between a head portion and an ink container according to the present invention.

The FIGS. 3A–3F show a process showing an example of the ink filling structure according to the present invention.

Figure 4:
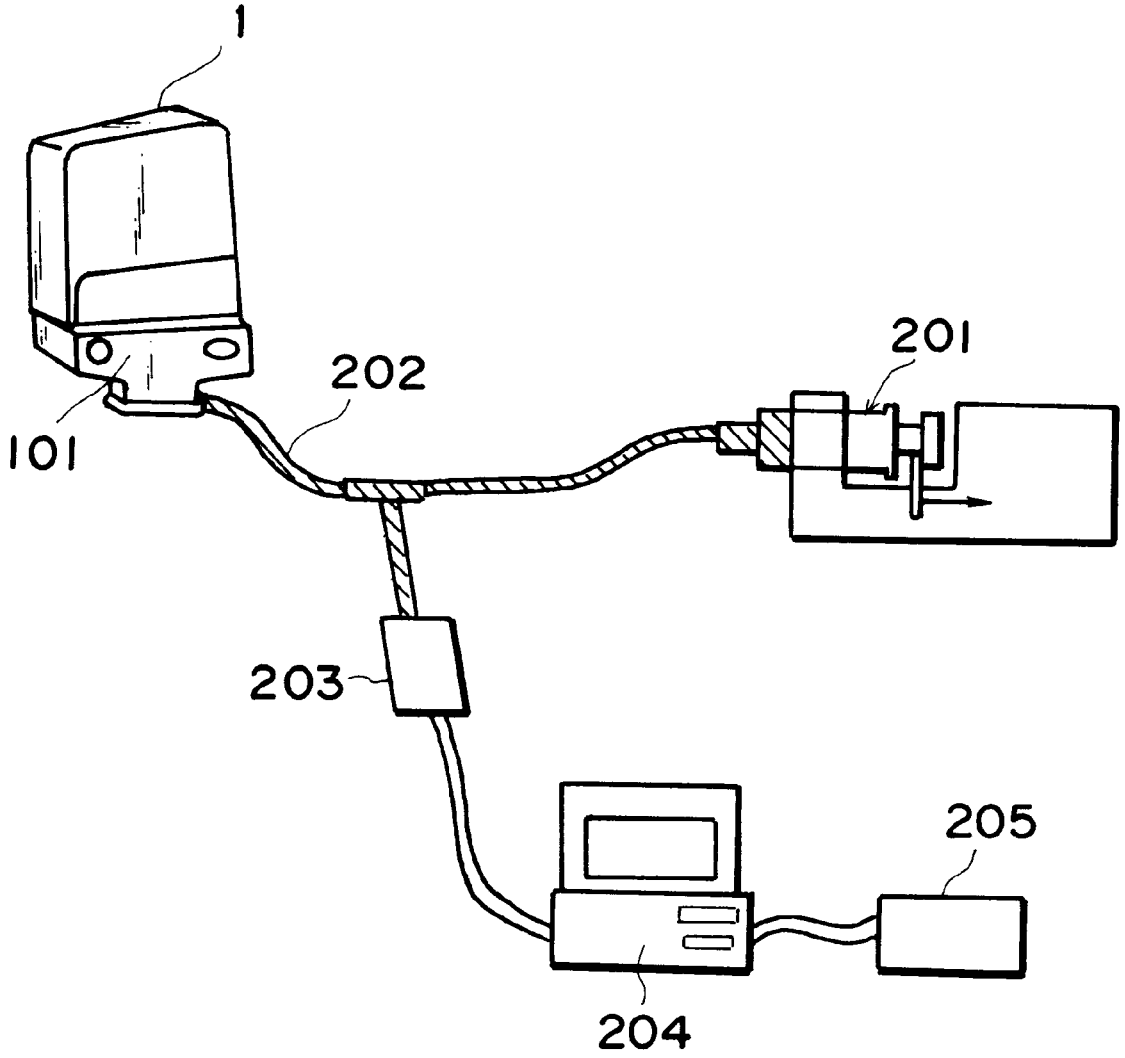

The FIG. 4 schematically shows an example of an apparatus for measuring a filling ink quantity in the porous material.

Figure 5:
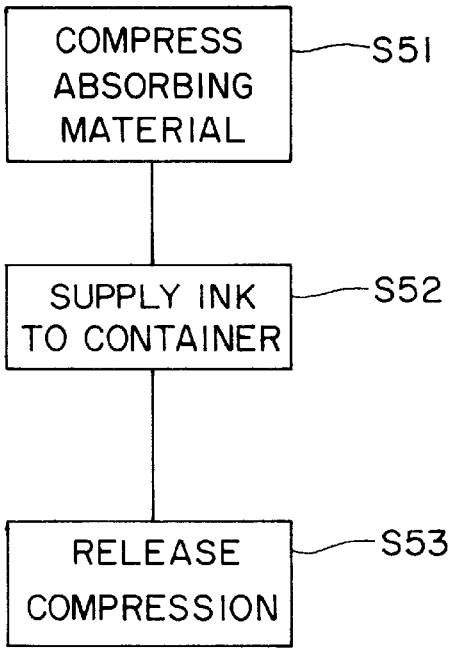
Figure 6:
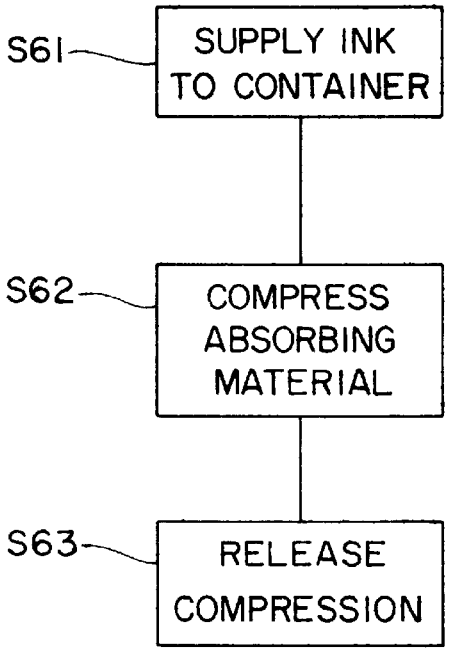

FIGS. 5 and 6 are flowcharts showing the sequence of steps of two respective ink filling methods according to the present invention.

DESCRIPTION OF THE PREFERRED EMBODIMENTS

Referring to the accompanying drawings, the present invention will be described.

The FIG. 2 is a partly broken sectional view schematically showing an example of an ink container and the head portion to which the ink container is mounted, according to the present invention.

In this example, reference numeral 1 designates an ink container, and 121 designates a head portion.

The ink container 1, comprises a casing 2 for the ink accommodation, a cover member 3 provided with the air vent 5 and covering the casing 2, and the upper member 4 having the handle portion 4*a* to be used at the time of effecting the mounting-and-demounting relative to the recording head cartridge 101 constituted by an ink container accommodation casing 102 and 103 and a head portion 121 and the air releasing opening 16 mounted to the top portion of the cover member 3 and having the space which becomes buffer chambers so that the ink leakage from an air vent 5 does not extend to the outside and provided at the position different from the position of the air vent 5.

The bottom portion of the ink container, is provided with an ink supply opening member 8 to which the discharge tube 106 of the recording head cartridge 101 is inserted and the rib 15 projecting around the circumference thereof, and inclination portions 14*a* and 14*b* for connecting the rib 15 with the ink supply opening 8. In addition, the surface of the side having the handle portion 4*a* of the ink container 1 is provided with the rib 12, and it is used as a guide for the mounting of the ink container 1, corresponding to a cut away portion formed in the recording head cartridge 101, so that the reliability of the mounting of the ink container 1 is assured.

In the ink container 1 is accommodated the ink absorbing material 6, and between the opening 8 for the ink supply and the ink absorbing material 6, the ink discharge member 7 is provided. A support 9 for supporting the member 7 in the container is erected corresponding to the opening 8. A part in the inside surface of the supporting portion 9 is provided with a slit 16 for communicating the outside with the inside of the ink container.

The cover member 3 is provided with a rib 13 and a stripe projection portion 3*a* in the front side of the cover member 3 so that the predetermined space is formed between the ink absorbing material 6 and the cover member 3 The stripe projection portion 3*a* is engaged with a cover portion 108 provided in the recording head cartridge 101 to apply force to the ink container 1 in the direction toward the lower portion of from the container.

The inner surface of the ink container is provided with a plurality of the ribs 11 continuing vertically so that a predetermined spaced portion is formed between the ink absorbing material and the side surface of the ink container.

In the ink container 1 thereof, the opening 8 for the ink supply is formed with eccentricity toward one side of the bottom surface of the ink container. Therefore, the ink absorbing material is easily deposited onto the bottom surface of the other one side of the ink container without the gap therebetween. If the ink absorbing material is contacted without the gap to the bottom surface of the ink container, the ink tends to stagnate at this portion, and in the case of occurrence of the stagnation of the ink , there is a liability that the ink leaks through the air vent and/or the opening for the ink supply, depending upon the pose of the ink container. In order to avoid such an inconvenience and to avoid that the ink absorbing material is contacted without the gap to the bottom portion of the ink container, the rib 10 is provided on the bottom surface of the ink container 1.

By the provision of the rib 10 and/or the rib 11 at the ink container inside in this manner, (additionally by the provision of the slit at the supporting portion 9), the opening 8 for the ink supply and the air vent 5 results in communicating with each other through the air layer.

By communicating the ink container inside with the outside by the air layer in this manner, firstly, although the inside pressure of the container changes during the transportation of the ink container, the pressure can be released by the ambience opening 16, and therefore, when the seal material sealing the ink supply opening is peeled, the discharge of the ink from the ink supply opening and/or the leakage can be prevented. Secondly, even in the case that the temperature of the ink container circumference rises during the printing execution, the ink is not pushed out to the outside because the container inside pressure change is eased by the ambience opening 16. Thirdly, by providing the rib 10, the ink absorbing material and the container inside wall, are out of contact with each other, and therefore, the ink tending to stagnate at the close contact portion does not easily stagnate so that the use efficiency of the ink is improved. These advantageous effects are provided.

For the purpose of decreasing the projection area relative to the recording head and increasing the ink capacity, the area of the bottom portion of the ink container 1 is reduced, and the height of the ink container, that is, the aspect ratio is increased. Additionally, the ink container 1 is provided with a step at substantially the middle portion of the ink container 1 so as to increase the accommodation volume for the ink.

The dimensions of the outside shape of the ink container 1 are the height of approx. 51.4 mm, the upper portion depth of approx. 38.4 mm the bottom portion depth of approx. 34.9 mm, the rib depth of approx. 2.7 mm, the upper portion width of approx. 16.9 mm, and the bottom portion width of approx. 11.1 mm, the height of approx. 24.4 mm from the bottom portion up to step portion of the ink container. Namely, the configuration of the ink container is such that it is widened slightly toward the upper portion from the bottom portion.

Opening for the ink supply of the ink container and the ink discharge portion of the recording head cartridge, will be described.

The ink discharge tube 106 of the recording head cartridge 101 is inserted into the inside through the ink supply opening 8 of the ink container 1, and is brought into contact with the ink discharge member 7 with pressure. The ink discharge member 7 is constituted by a bundle of fibers extending in one way for properly discharging the ink in the absorbing material 6 of the ink container to the outside, and the flow of the ink toward the ink discharge tube from the absorbing material is made further proper by producing difference of the density in the ink discharge member 7 in contact with the ink discharge portion 106 in this manner, so that the improvement of the ink supply performance can be expected.

In addition, the rib 15 provided in the circumference of the ink supply opening 8 of the ink container, is subjected to the urging force by the cover portion 108 and is press-contacted to the elastic member 104 provided on the bottom surface of the recording head cartridge, and enters it to be bitten thereby. By this, the leakage of the ink therefrom to the outside can be suppressed.

As described in the foregoing, the ink container and the recording head cartridge is connected, and therefore easy and assured mounting can be accomplished. In addition, the mounting space is minimized using the rotation, and the projection area of the ink container per se can be reduced so that the downsizing of the device can be accomplished without decreasing the ink capacity.

Into the ink container constructed as described in the foregoing, the ink is filled by the process as shown in FIG. 3A–FIG. 3F.

Figure 3A:
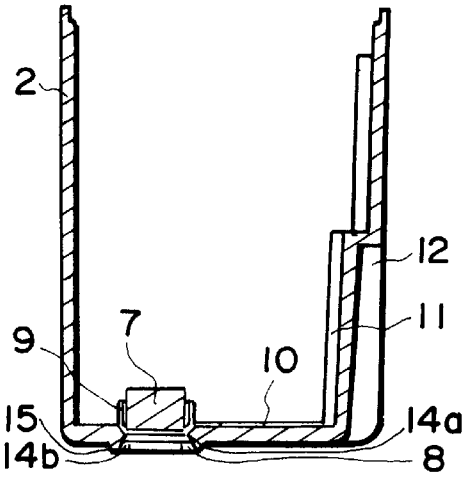

First, as shown in FIG. 3A, the casing 2 constituting the ink container 1 closing at one side and opening at the other side is provided. In the side of the casing 2 which is closed, the ink supply opening 8 which becomes the connection portion with the head portion is provided, and the ink discharge member 7 is connected thereto. The outside surface of the ink supply opening 8 is sealed by the seal means beforehand, and during the ink filling process to be executed thereafter the ink leakage from the ink supply opening 8 is also prevented.

Figure 3B:
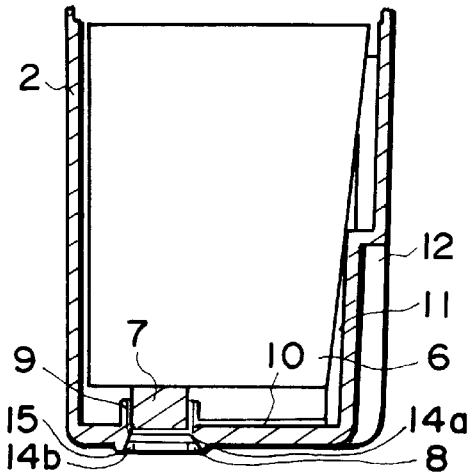

Into the casing 2 in this state, the porous absorbing material 6 is inserted through the opening side, as indicated in FIG. 3B. The porous absorbing material 6 to be inserted is cut into the shape substantially corresponding to the inner shape of the casing 2 (or the inside volume), beforehand. In the present invention, as will be described hereinafter, the porous absorbing material 6 is compressed, and the ink is filled using restoration of the material from the compression state. Therefore, the relation in the configuration or the size between the inner shape of the casing 2 and the porous absorbing material 6 are important factors. Namely, if the configuration of the porous absorbing material 6 is too large relative to the inner shape of the casing 2, the friction between the outside surface of the porous absorbing material 6 and the inside surface of the casing 2 is too large, and therefore, the desired restoration of the porous absorbing material 6 is not accomplished with the result that the ink filling as expected is not accomplished.

If the configuration of the porous absorbing material 6 is small relative to the inner shape of the casing 2, the contact between the ink discharge member 7 provided in the ink supply opening 8 and the porous absorbing material 6 is not properly maintained, and therefore, the ink supply performance is adversely influenced. Therefore, as the relationship for satisfying both of the requirements, it is also preferable that the volume of the porous absorbing material 6 having a substantially similar configuration, relative to (the inside volume) the inner shape of the casing 2, is about 1.0–1.2 times. In addition, the restoring force of the porous absorbing material 6 is different also depending on the property of the porous absorbing and on the degree of the compression in the molding or the like, but the proper restoring force is provided using the above described value range.

Figure 3C:
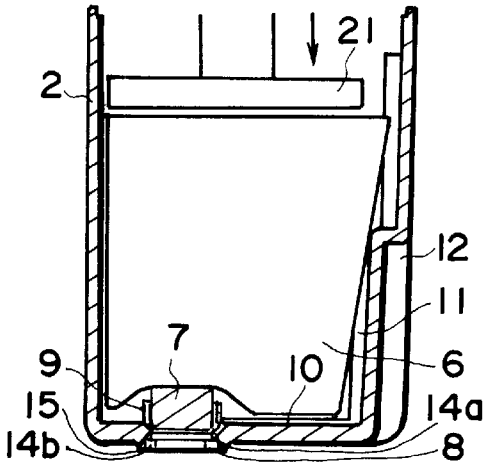

The porous absorbing material 6 accommodated in the casing 2, as shown in FIG. 3C, is compressed by urging it using urging member 21. As will be explained below, the urging member 21 may be used both to compress the porous absorbing material and to release the material from the compressed state; accordingly, urging member 21 may be characterized as a compressing means and a releasing means. As to the degree of the compression by the urging member 21, if the degree of the compression is too small, the quantity of the ink filled in the porous absorbing material 6 is too small, and if it is pressed too much, the sufficient restoration is not expected (with the result of the plastic deformation), and the ink filling quantity is also reduced. In addition, it is different also depending on the property of the used porous absorbing material 6, and, for example, in the case that the porous absorbing material 6 is the compression molded material, the capable degree of compression by the urging member 21 is also limited by itself depending on the degree of the compression in the compression molding, and the preferable degree is to approximately ½ to ⅕ of the original uncompressed volume of the material.

Figure 3D:
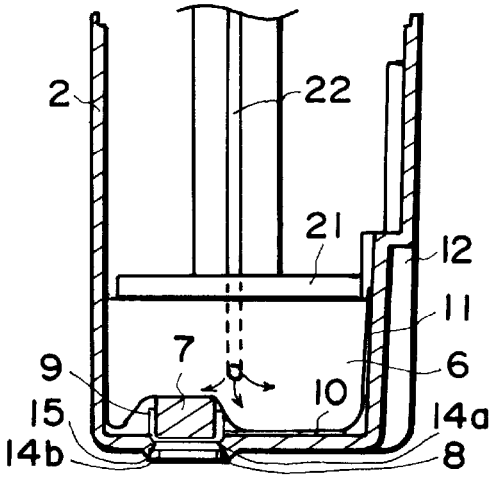

Into the porous absorbing material 6 compressed to the predetermined degree, as shown in FIG. 3D, the ink supply tube 22 (which may be characterized as a supplying means)

for the ink supply is inserted, and the ink is supplied from the ink supply tube 22.

Figure 3E:
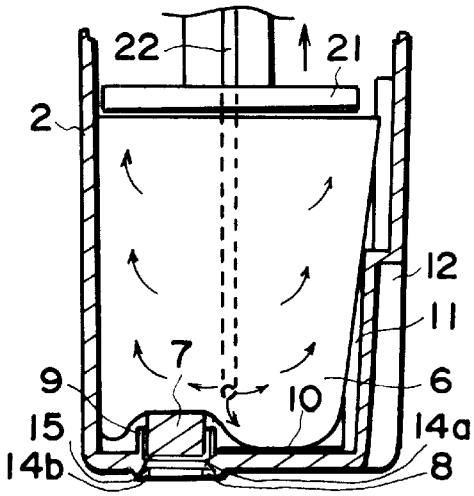

While executing the supply of the ink as shown in FIG. 3E, the compression state of the porous absorbing material 6 by the urging member 21 is released. As the compression state is eased, the porous absorbing material 6 restores to the original shape, the ink supplied is filled by moving as indicated in the arrow in the ink absorbing material. The steps of the ink filling procedure depicted in FIGS. 3C, 3D and 3E are shown schematically in FIG. 5 (steps S51, S52 and S53 respectively).

Figure 3F:
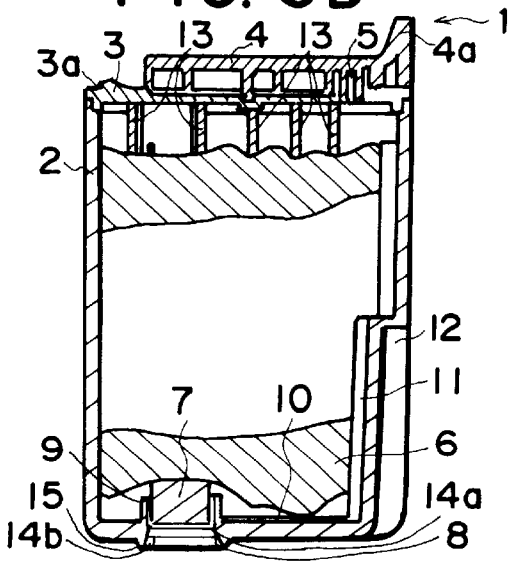

To the opening side of the casing 2 for which the filling of the ink is completed, as indicated in the FIG. 3F, the cover member 3 and the upper member 4 are mounted, by which the ink container filled with a desired amount of the ink without the free ink, is produced.

Thereafter, a label having a lot number or the like is stuck the ink container, and the ink container, is packaged.

The maximum ink quantity of the porous absorbing material 6( capable of the filling) is obtained in the following manner.

As indicated in the FIG. 4, the end of a sucking pump 201 (available from TERUMO Kabushiki Kaisha, Japan, Terufusion Syringe Pump) connected through the tube 202, to the head portion 101 of the cartridge for which the ink container 1 containing the porous absorbing material 6 is mounted, and in addition, the pressure change is measured during the ink sucking by the sucking pump 201, and a pressure sensor 203 for measuring the change of the sucking pressure is provided in a portion of the tube 202. The result of detection of the pressure sensor 203, is measured by a measuring device 204 and is outputted by the printer 205.

As for the measurement method, the flow rate at the time of sucking the ink from the head portion 101 by the sucking pump 201 is controlled to a predetermined value (the flow rate thereof is set to the ejection rate in the case of ejection from all of the ejection outlets), and the operation of sucking 1 cc of the ink at this flow rate and the operation of keeping it as it is, until the pressure after the sucking returns to the static pressure, are repeated until the point of time at which it does not return to the static pressure, and at which the dynamic pressure becomes not less than 200 mmAq during the sucking (the point of time is discriminated as the use limit point of the porous absorbing material having consumed the ink in the ink container). The number of repetitions, substantially corresponds to the usable ink quantity of the porous absorbing material 6 accommodated in the ink container because the ink quantity sucked by the sucking operation is 1 cc.

In the following embodiment specific examples will be described. Suitable examples of porous material 6 are obtained by heat compressing the material 2–4 times (that is, 2 to 4 repetitions) beforehand. The material in the container casing is then compressed to a fraction of the original uncompressed volume of the material, as detailed below.

As the porous absorbing material 6, 4-times compressed porous absorbing material (the cell number of the porous absorbing material thereof is 168–200/inch), 3-times compressed porous absorbing material (the cell number of the porous absorbing material thereof is 126–150/inch), 2-times compressed porous absorbing material (the cell number of the porous absorbing material thereof is 84–100/inch) the non-compression absorbing material (the cell number of the porous absorbing material thereof is 42–50/inch), namely, 4 kinds of the materials are prepared, and they are accommodated in the casing 2, and thereafter, as shown in FIG. 3 they are compressed to, ⅙, ⅕, ¼, ⅓, ½ and ¾ of the original uncompressed volume of the material, respectively, by the urging member 21, thus, the ink is filled using the restoration function thereof.

TABLE 1

| comp. comp. ratio | No. of cells/ inch | 3/4 | 1/2 | 1/3 | 1/4 | 1/5 | 1/6 |
|---|---|---|---|---|---|---|---|
| 4 times | 168–200 | N | G | E | E | — | — |
| 3 times | 126–150 | N | N | G | E | E | — |
| 2 times | 84–100 | N | N | G | G | G | G |
| non | 42–50 | N | N | N | N | N | N |

The result of the ink filling property in these examples are showed in Table 1. In the Table 1, "E" means that almost 100% of the ink quantity accommodatable by the porous absorbing material could be filled properly, "G" means that the porous absorbing material is not filled with all of the ink quantity capable of the accommodation thereof, but not less than the approx. 85% was filled, and there was substantially no problem in the ink supply, and "N" means that the ink filling of only not more than 80% was possible.

According to the result in this example, by compressing the porous absorbing material which has been compression-molded to not less than 2 times, to not less than ⅓ in the ink container, the proper ink filling is accomplished.

In addition, the non-compression absorbing material does not show sufficient restoring force, and any compression states did not show proper ink filling property.

The ink filling method is not limited to the above described method, and the restoration of the porous absorbing material may be intermittent rather than continuous, and the supply may be intermittent or continuous in accordance with the state of the restoration of the porous absorbing material.

In addition, in the ink container of the structure wherein the space which becomes the buffer chamber of the ink is provided at a top portion of the ink container as shown in FIG. 2, after the ink of the predetermined amount may be supplied into the ink container, the porous absorbing material may be compressed to execute the filling of the ink. This embodiment of the ink filling method is shown schematically in FIG. 6 (steps S61, S62 and S63).

In addition, in another alternative, the porous absorbing material is accommodated in the ink container, and the cover member is mounted to the opening portion of the casing 2, and thereafter the tube for the ink supply is inserted through the air vent of the cover member, and the porous absorbing material is compressed by the tube, and thereafter the tube is drawn upwardly to supply the ink while restoring the porous absorbing material.

In another alternative, the ink supply tube and the urging member used in the ink filling process as shown in FIGS. 3A–3D, may be unified.

As described in the foregoing, in the present invention, by filling the ink using the restoring force of the porous absorbing material absorbing the ink, the bulky ink filling device is unneccesary, and the filling of the ink can be executed easily under the atmospheric pressure.

In addition, there is not free ink, and the extraction process for the free ink is unnecessary, and the filling of the ink with which the variations of the distribution or the filling quantity of the ink do not easily occur, can be executed.

While the invention has been described with reference to the structures disclosed herein, it is not confined to the details set forth and this application is intended to cover such modifications or changes as may come within the purposes of the improvements or the scope of the following claims.

What is claimed is:

1. An ink filling method in which ink is filled to an ink container provided with a head portion for electing ink, a porous material for retaining the ink to be supplied to the head portion, and a container casing for accommodating the porous material, the method comprising the steps of:

compressing the porous material accommodated in said container casing to a size smaller than an inner size of said container casing; and filling the porous material with the ink using a restoring force of the porous material in the container when the porous material is released from compression.

2. An ink filling method according to claim 1, wherein said compressing step is executed mechanically.

3. An ink filling method according to claim 1, wherein said filling step is executed under atmospheric pressure.

4. An ink filling method according to claim 1, wherein said filling step is performed after said compressing step, and said filling step further comprises the step of releasing the porous material from the compression state, said releasing step being performed while the porous material is filled gradually.

5. An ink filling method according to claim 4, wherein said filling step further comprises the step of releasing the porous material from the compression state continuously.

6. An ink filling method according to claim 4, wherein said filling step further comprises the step of releasing the porous material from the compression state intermittently.

7. An ink filling method according to claim 1, further comprising the step of:

providing a compressing member for compressing the porous material and an ink supply tube for supplying the ink to the container casing, wherein said compressing step further comprises the step of compressing the porous material with said compressing member, and said filling step further comprises the step of supplying the ink to the container casing with said ink supply tube.

8. A method according to claim 7, wherein the container casing has an ink supply port provided therein for supplying the ink to the head portion, and the ink supply tube is inserted into said porous material adjacent said ink supply port.

9. An ink filling method according to claim 7, wherein said providing step comprises providing said ink supply tube for use both as said compressing member and for supplying the ink.

10. An ink filling method according to claim 1, wherein the porous material as been heat-compressed 2 times–4 times beforehand from an original uncompressed volume, and the compression of the porous material in the container casing is such that a compressed volume of the material is ½–⅕ of the original uncompressed volume of the material.

11. A method according to claim 1, wherein the container casing has a side with an ink supply port provided therein for supplying the ink to the head portion, and the porous material is compressed in said compressing step in a direction substantially perpendicular to said side.

12. An apparatus for filling ink to an ink container, comprising:

compressing means for compressing an ink absorbing material accommodated in the ink container, said compressing means compressing the ink absorbing material to a size smaller than an inner size of the ink container;

releasing means for releasing the ink absorbing material from compression; and supplying means for supplying the ink to the ink container.

13. An apparatus according to claim 12, wherein said compressing means, said releasing means and said supplying means are a common member.

14. An apparatus according to claim 12, wherein during an ink filling operation, said supplying means is inserted into said compressing means and then into the ink absorbing material.

15. An apparatus according to claim 12, wherein the ink is supplied to the ink container, and thereafter the ink absorbing material is filled with the ink in accordance with release of the ink absorbing material from the compression state.

16. An apparatus according to claim 12, wherein the ink is supplied to the absorbing material as a result of restoration of the ink absorbing material in accordance with release of the ink absorbing material from the compression state.

* * * * *

UNITED STATES PATENT AND TRADEMARK OFFICE

CERTIFICATE OF CORRECTION

PATENT NO. : 5,980,031

DATED : November 9, 1999

INVENTOR(S) : Toshiaki Sasaki, et al.

It is certified that error appears in the above-identified patent and that said Letters Patent is hereby corrected as shown below:

Column 1

Line 37, change "it" to --It--.

Column 2

Line 11, delete "a";
line 16, change "occurs" to --occur--; and
line 50, change "carry" to --carried--.

Column 3

Line 14, change "is released the compression state" to --the compression state is released--; and line 25, delete the second occurrence of "to".

Column 10

Line 6, change "as" to --has--.

Signed and Sealed this

Seventh Day of November, 2000

*Attest:*

Q. TODD DICKINSON

*Attesting Officer*

*Director of Patents and Trademarks*